United States Patent [19]

Hamano

[11] Patent Number: 4,816,865

[45] Date of Patent: Mar. 28, 1989

[54] DOCUMENT CONVEYING APPARATUS

[75] Inventor: Hiroaki Hamano, Okazaki, Japan

[73] Assignee: Minolta Camera Kabushiki Kaisha, Osaka, Japan

[21] Appl. No.: 122,218

[22] Filed: Nov. 18, 1987

[30] Foreign Application Priority Data

Nov. 19, 1986 [JP] Japan ..... 61-275637

[51] Int. Cl.[4] ..... G03G 15/00

[52] U.S. Cl. ..... 355/14 SH; 355/3 SH; 355/3 R; 355/14 R

[58] Field of Search ..... 355/3 R, 3 SH, 14 SH, 355/14 R

[56] References Cited

U.S. PATENT DOCUMENTS

| | | | |
|---|---|---|---|
| 4,392,740 | 7/1983 | Ito et al. | 355/14 SH |
| 4,394,088 | 7/1983 | Hanamoto et al. | 355/14 R |
| 4,449,812 | 5/1984 | Furuichi et al. | 355/14 SH |
| 4,563,079 | 1/1986 | Inuzuka et al. | 355/8 |
| 4,621,921 | 11/1986 | Takahata et al. | 355/14 R X |
| 4,739,366 | 4/1988 | Braswell et al. | 355/14 SH |

OTHER PUBLICATIONS

IBM Technical Disclosed Bulletin, vol. 19, No. 5, 10–76.

*Primary Examiner*—A. C. Prescott

*Attorney, Agent, or Firm*—Burns, Doane, Swecker & Mathis

[57] ABSTRACT

A document conveying apparatus having a document conveying path, a plurality of document conveying units, and a plurality of document detecting units, the conveying and detecting units being disposed along the conveying path. The apparatus includes an inserting unit having a unit which detects, when the document detecting units are operating in a predetermined sequence while a document is being conveyed, an abnormality of the document according to the states of the respective document detecting units at a predetermine timing and a unit to stop the operation of the abnormality detecting unit. The document is conveyed from the inserting unit via an exposed unit to an ejecting unit.

6 Claims, 4 Drawing Sheets

DOCUMENT CONVEYING APPARATUS

BACKGROUND OF THE INVENTION

1. Field of the Invention

The present invention relates to a document conveying apparatus in which an original document is subjected, for a copy operation thereof, to a light irradiation at a predetermined position while the original document is being conveyed through a constant path.

2. Description of Related Art

Conventionally, in a document conveying apparatus of this kind, when the operator recognizes that a wrong document is inserted or a document sheet is inserted in an inclined state immediately after the insertion of the document, the operator attempts in an ordinary case to draw out the document from the apparatus and to stop the copy operation.

On the other hand, in a document conveying apparatus of this kind, a plurality of document detecting means disposed along a document conveying path are so configured to detect a paper jam condition based on a sequential operation thereof according to the conveyance of the document.

Consequently, when a document is inserted in the apparatus, the paper jam detecting function is automatically started and hence if the document is drawn out, the apparatus regards by itself that a paper jam has occurred. As a result, the operator must take a troublesome action to reset the paper jam detection in each such a situation.

It is therefore an object of the present invention to provide a novel document conveying apparatus.

Another object of the present invention is to provide a document conveying apparatus in a copying machine in which a document is subjected to a light irradiation at a predetermined position while the document is being conveyed through a constant path.

SUMMARY OF THE INVENTION

According to the present invention, these objects can be achieved by a document conveying apparatus for conveying a document manually inserted from an inserting section to an ejecting section via an exposing section comprising a conveying path extending from said inserting section via said exposing section to said ejecting section, means for conveying the document along said conveying path, a plurality of document detecting means disposed along said conveying path for operating in a predetermined sequence when the document is normally conveyed, means for detecting an abnormality in document conveyance depending on a state of each said detecting means at a predetermined timing, and means for stopping an operation of said abnormality detecting means; when said plurality of detecting means operate in a sequence other than said predetermined sequence.

These objects can be achieved by a document conveying apparatus for conveying a document manually inserted from an inserting section to an ejecting section via an exposing section comprising a conveying path extending from said inserting section via said exposing section to said ejecting section, first and second document detecting means each disposed along said conveying path, said second document detecting means being disposed at a location downstream in a conveying direction with respect to said first document detecting means, means for detecting an abnormality of document conveyance based on detected states respectively of said first and second document detecting means, means for initiating said conveying means and said abnormality detecting means in response to said first document detecting means, and means for stopping operations of said conveying means and said abnormality detecting means, while said first document detecting means is detecting the document, when said second document detecting means changes from a document detecting state to a state where the document is not detected.

These objects can be achieved by a document conveying apparatus for conveying a document manually inserted from an inserting section to an ejecting section via an exposing section comprising a conveying path extending from said inserting section via said exposing section to said ejecting section, means disposed in said inserting section and provided with a conveying roller movable to an operative position and to a retracted position for conveying the document along said conveying path, first detecting means for detecting an operation to insert a document into said inserting section, means for moving said conveying roller from the retracted position to the operative position in response to said first detecting means, second detecting means for detecting an operation to draw out the document after said conveying roller is moved to the operative position, and means for moving said conveying roller from the operative position to the retracted position in response to said detecting means.

According to the present invention, when a document is inserted to the apparatus, a plurality of document detecting means disposed along a conveying path of the document operates in a sequence such that when the operation to convey the document is reversed, the detection of a paper jam is thereafter disabled; consequently, when the document once inserted is drawn out because of a mistake, this condition is not detected as a paper jam. As a result, the operator can be relieved from a troublesome burden to reset the paper jam for each such operation and is immediately enabled to resume the document insertion.

BRIEF DESCRIPTION OF THE DRAWINGS

The present invention will be apparent from the following detailed description taken in conjunction with the accompanying drawings in which.

DESCRIPTION OF THE PREFERRED EMBODIMENTS

Referring next to the accompanying drawings, description will be given of an embodiment of a document conveying apparatus according to the present invention.

Figure 1:
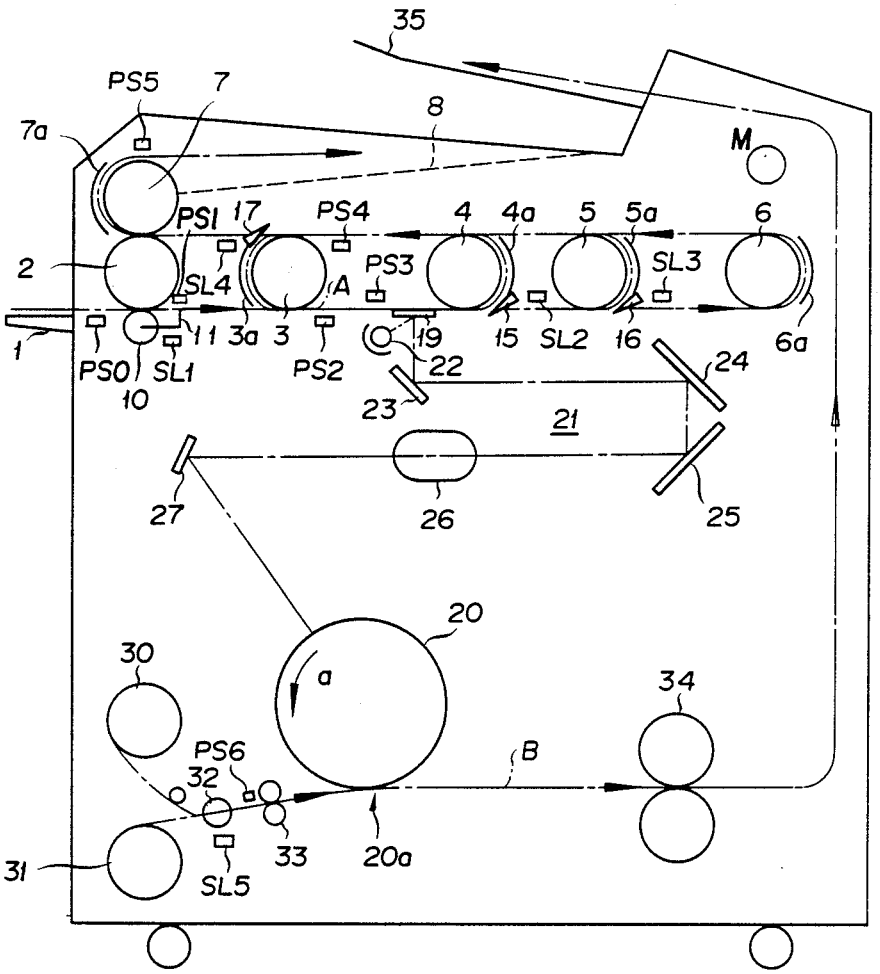
FIG. 1 is a schematic diagram showing a configuration of a document conveying apparatus according to the present invention in which the document conveying apparatus is incorporated in a copying machine.
Figure 2:
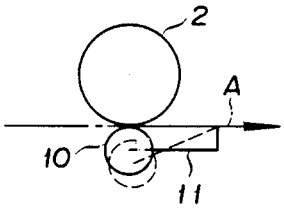
FIG. 2 is an explanatory diagram useful to explain a document inserting section.

In this embodiment, as shown in FIG. 1, a document inserted thereinto is circulated through a constant path according to the number of copies to be generated. The configuration of the embodiment substantially includes a document insertion guide plate 1, original document conveying rollers 2–7, a conveying motor M for driving these document conveying rollers 2–7, and an original document ejecting tray 8 and is incorporated in an upper portion of the body of the copying machine.

Below the original document conveying roller 2, there is detachably disposed an original document inserting roller 10 and a stopper 11 integrally arranged therewith. The inserting roller 10 and the stopper 11 are driven by a solenoid SL1, and in an ordinary situation, the inserting roller 10 is separated from the conveying roller 2 and the stopper 11 is located in an original document conveying route indicated by a dot-and-dash line A. On the other hand, when the solenoid SL1 is turned on, the inserting roller 10 is brought into contact with the conveying roller 2 and the stopper is retracted from the original document conveying route so as to be ready to convey an original document.

Figure 3:
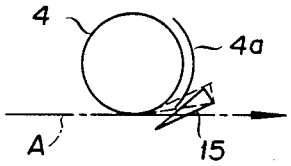
FIG. 3 is an explanatory diagram useful to explain a change-over claw section.

The conveying rollers 3–7 include guide plates 3*a*–7*a*, respectively, and the conveying rollers 4–5 have change-over claws 15–16, respectively to change over between the circulating conveying routes. The conveying roller 3 is provided with a change-over claw 17 to change-over between original document circulating and ejecting operations. The change-over claws 15–17 can be retractably inserted in the original document conveying route indicated by a dot-and-dash line A by means of solenoids SL2, SL3, and SL4, respectivly (refer to FIG. 3).

That is, an original document is guided by the respective guide plates 3*a*–7*a* so as to be conveyed in a circulating fashion along the conveying rollers 3–7, respectively. When the change-over claw 15 is inserted in the original document conveying route with the change-over claw 17 beforehand located therein, the original document is circulated between the conveying rollers 3 and 4. When the change-over claw 16 is positioned in the conveying route with the change-over claw 15 retracted therefrom, the original document is circulated between the conveying rollers 3 and 5. When the change-over claw 17 is positioned in the conveying route with the change-over claws 15–16 retracted therefrom, the original document is circulated between the conveying rollers 3 and 6. When the change-over claw 17 is retracted from the original document conveying path, the original document is ejected from the conveying roller 7 into the ejecting tray 8.

Furthermore, photosensors PS1–PS5 for detecting an original document are disposed in the original document conveying path. The sensor PS1 detects an insertion of an original document and cooperates with timers A and B (not shown) to be described later so as to detect the length of the original document. The sensor PS2 is used to detect a reference position of the original document, the sensor PS3 is a reference sensor to start the timers A and B, the sensor PS4 is provided to establish a timing for an operation of the change-over claw 17, and the sensor PS5 detects an ejection of the original document.

The respective sensors PS0 to PS5 are used to detect a document jam. That is, when the first end of the document is detected by a sensor, the system starts a timer to which a period of time to be elapsed by when the first end of the document reaches the next sensor is set so as to detect a paper jam. Namely, a paper jam is accordingly assumed if the first end of the document is not detected by the next sensor when a time-out occurs in the timer. Moreover, the sensors PS0–PS2 also have a function to detect a condition that the document is drawn out from the inserting section such that the paper jam detection is disabled in this condition, which will be described later in detail.

Next, a brief description will be given of the configuration of the copying section.

A photosensitive drum 20 can be driven into a rotation in a direction indicated by an arrow mark a and is provided with known image forming elements such as an electric charger and a developing system arranged in the periphery of the photosensitive drum 20. An optical system 21 includes an exposure lamp 22, mirrors 23, 24 and 25, a lens 26, and a mirror 27 so as to irradiate a light onto an original document conveyed on a glass plate 19 located between the conveying rollers 3 and 4, thereby effecting a slit exposure on the photosensitive drum 20 by use of a reflected light from the original document.

Two kinds 30 and 31 of copy paper in a shape of a roll are installed so as to be selectively supplied for the copy operation. The selected copy paper is conveyed through a cutter 32 and a timing roller pair 33 driven by the solenoid SL5 to a transfer section 20*a*. The copy paper on which an image is transferred by the transfer unit 20*a* is fed as indicated by a dot-and-dash line B in FIG. 1 and then the toner is fixed in a fixing unit 34. The copy paper is then ejected into the ejection tray 35 located in the upper portion of the copying machine. In addition, there is disposed a copy paper detecting sensor PS6 immediately before the timing roller pair 33.

Figure 4:
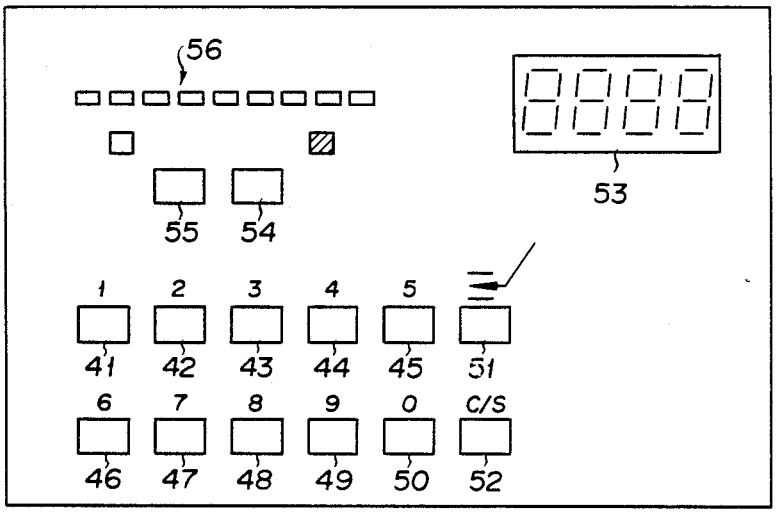
FIG. 4 is a plain view of an operator's panel.

FIG. 4 is a schematic diagram showing an operator's panel including ten keys 41–50, an interruption key 51, a clear/stop key 52, and a display section 53 to display the number of copied sheets and trouble codes such as a code of a paper jam. The system further comprises up/down keys 54–55 to vary the amount of exposure and a group of display LED's 56.

Figure 5:
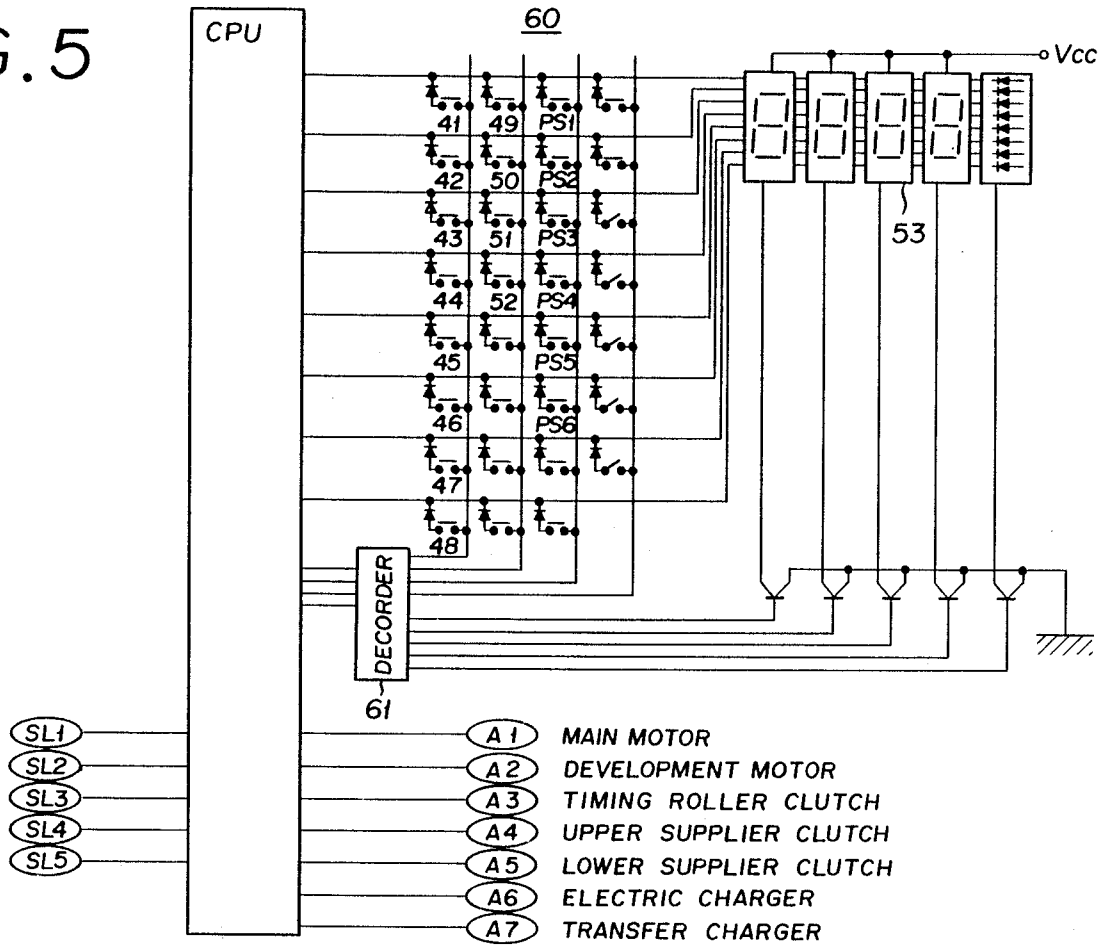
FIG. 5 is a block diagram schematically depicting a control circuit.

FIG. 5 is a schematic circuit diagram showing a control circuit in which a switch matrix 60 is connected to a microcomputer (CPU) controlling the operations of the copying machine, and the display section 53 is connected via the matrix 60 and a decoder 61 to the CPU. Furthermore, the CPU has output terminals connected to the solenoids SL1–SL5, a main motor of the copying machine, a paper supplying clatch, various chargers, and the like.

Description will now be briefly given of the operation of the copying machine constituted as described above.

The copying machine starts a copy operation when the sensor PS1 detects a condition that an original document is inserted from the guide plate 1.

That is, when an original document is inserted along the surface of the guide plate 1 and a first end of the original document is sensed by the sensor PS1, the solenoid SL1 is turned on, the inserting roller 10 is pressed against the conveying roller 2, the stopper 11 is retracted from the original document conveying route, and the original document is fed in the direction indicated by the arrow mark. When the end of the original document is sensed by the sensor PS 2, the rotary operation of each roller is temporarily stopped. The copy paper 30 or 31 in the roll shape beforehand selected is then supplied, and when a first end of the copy paper 30 or 31 is sensed by the sensor PS6, the paper supplying operation is temporarily stopped.

On the glass plate 19, the document undergoes an irradiation of the light from the lamp 22 so as to generate a static latent image of the document image on the external peripheral surface of the photosensitive drum 20 by means of the lens 26 and the like. The static latent image is then transformed into a toner image by a developing device (not shown). When a predetermined period of time is elapsed after the first edge of the document is detected by the sensor PS3, the timing roller pair 33 is driven so as to convey the copy form to the transfer section 20*a* in synchrony with the toner image, The cutter 32 is initiated at a timing associated with the length of the document to cut off the copy form.

Next, referring to FIGS. 6–7, the operation of the automatic document circulating and conveying apparatus will be described.

Figure 6:
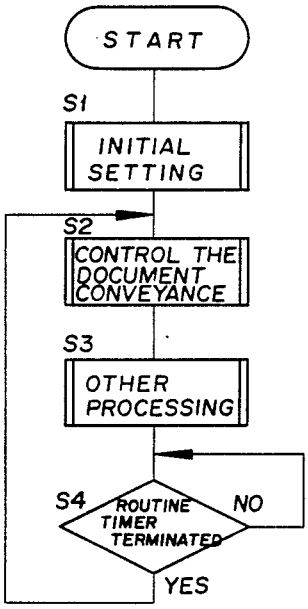
FIGS. 6–7 are flowcharts showing processing procedures.

FIG. 6 is a flowchart of the main routine of the microcomputer CPU.

When the CPU is activated to start the program, step S1 is executed to clear the random access memory RAM, to initialize various registers, and to initialize the respective components to the initial mode. Thereafter, in step S2, a subroutine controlling the conveyance of the original document (to be described later) is called, and in step S3, a subroutine controlling the other processing is called. The step S3 is provided for an execution of the control of the copy operation and the like, which has already been well known; consequently, description thereof will be omitted.

Furthermore, in step S4, it is checked to determine whether or not the routine timer has been terminated. After the timer is terminated, control is returned to the step S2. The routine timer is employed to determine a period of time required for the main routine and the value thereof is set during the initial setting operation in the step S1 and is used as the reference of the timers of the respective subroutines.

Figure 7:
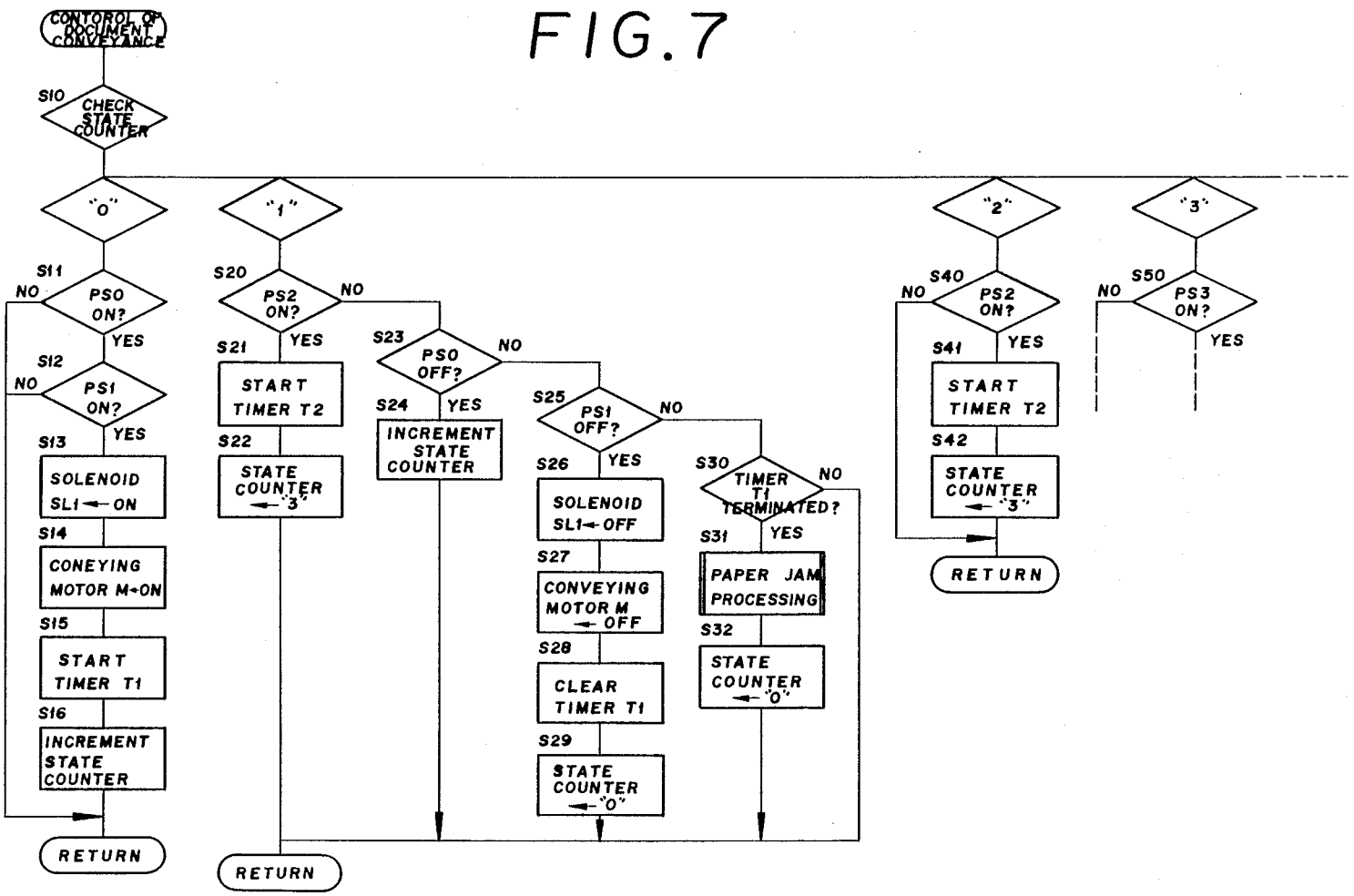

FIG. 7 is a flowchart illustrating a subroutine to be executed in the step S2 of the main routine to control the document conveyance.

First, step S10 is executed to check the state counter so as to select the subsequent step according to the count value.

When the state counter contains "0" indicating the initial state, steps S11–S12 are achieved to determine whether or not the sensors PS0 and PS1 are on. If both of PS0 and PS1 are off, namely, if the document has not been inserted into the apparatus yet, control is immediately transferred to the main routine; otherwise, the sensors PS0 and PS1 are turned on and then step S13 sets the solenoid SL1 to on and step S14 turns the conveying motor M on. This causes the inserting roller 10 to push the document against the conveying roller 2 and the stopper 11 to be retracted from the conveying path, thereby inserting the document into the apparatus.

At the same time, in step S15, the timer T1 to check for a paper jam is started and then step S16 increments the state counter and passes control to the main routine. The timer T1 is disposed to detect a paper jam in a range from the sensor PS1 to the sensor PS2 and is consequently set to a period of time during which the document is to be conveyed from the sensor PS1 to the sensor PS2.

In the step S16, when the state counter is incremented to "1", step S20 is initiated to determine whether or not the sensor PS2 is on. If this is the case, namely, the first end of the original document is detected by the sensor PS2, step S21 starts the timer T2 to detect a paper jam, and then step S22 sets the state counter to "3" and transfers control to the main routine. The timer T2 is used to detect a paper jam in a range from the sensor PS2 to the next sensor PS 3 and is consequently set to a period of time during which the document is to be conveyed from the sensor PS2 to the sensor PS3.

On the other hand, when the sensor PS2 is off, namely, the first edge of the document has not reached the sensor PS2 yet, step S23 determines whether or not the sensor PS0 is off. If the sensor PS0 is off, step S24 increments the state counter and passes control to the main routine.

If the step S23 judges that the sensor PS0 is in the on state, step S25 determines whether or not the sensor PS1 is off. If the sensor PS1 is off (when the document is ready for the conveyance, the sensor PS1 is naturally set to on), step S30 judges whether or not the timer T1 has already been terminated. If the timer T1 has not been terminated yet, control returns to the main routine; whereas if the time T1 has already been terminated, since the first edge of the document has not reached the next sensor PS2 within the predetermined period of time, the apparatus assumes a paper jam and hence step S31 executes a subroutine processing the paper jam, and then step S32 resets the state counter to "0" and transfers control to the main routine. The paper jam processing accomplished in the step S31 causes to stop the operations of such components as the conveying motor M and to display a paper jam code in a display field 53 of the operator's panel; furthermore, this state is reset after the operator removes the document from the apparatus. Since the paper jam processing is well known, details thereabout will not be described here.

Incidentally, if the step S25 determines that the sensor PS1 is off, namely, if the original document has been drawn out from the inserting section and the sensor PS1 once turned on is set to off, step S26 turns the solenoid SL1 off and then step S27 turns the conveying motor M off. At the same time, in step S28, the timer T1 detecting a paper jam is cleared, and in step S29, the state counter is reset to "0". This causes the inserting roller 10 to separate from the conveying roller 2, the stopper 11 to enter the conveying path, and the apparatus to return to the initial state and to stop the operation thereof. Moreover, the paper jam detecting function is also disabled without effecting the subsequent steps S30–S31.

In the step S24, when the state counter is incremented to "2", step S40 judges whether or not the sensor PS2 is on. If the sensor PS2 is on, control is immediately returned to the main routine; otherwise, step S41 starts the timer T2 detecting a paper jam between the sensors PS2 and PS3 and then step S42 sets the state counter to "3" and returns control to the main routine.

When the document is conveyed in a normal sequence and hence the state counter is set to "3" in the step S22 or S42, it is judged whether or not the sensor PS3 is on in step S50. Thereafter, while executing a detection of a paper jam, the apparatus carried out processing to circulate and to eject the original document. The length of the document is detected by a combination of such components as the sensors PS0–PS3 and the timers such that the document is circulated through conveying path corresponding to the length, namely, between the conveying rollers 3–4, 3–5, or 3–6 as many times as there are copies. Finally, the document is delivered by the conveying roller 7 and is ejected onto the document ejecting tray 8. The conveyance of the document is accomplished by controlling the on and off states of the solenoids SL2, SL3, and SL4. Details thereabout, however, will not be described.

As described above, in the present embodiment, a combination of the sensors disposed along the document conveying path and the associated timers are used to detect the jam of the document [steps S12, S15, S20, and S30]. On the other hand, when the document is drawn out from the inserting section, the sensors operate in a reverse fashion as compared with that in a case of the document conveyance [YES in the step S25]. In this case, the apparatus is returned to the initial state so as to be stopped and the timers to detect a paper jam are disabled to prevent the subsequent detection of the paper jam [steps 26–29].

In this embodiment, although the conveying apparatus is so configured to automatically circulate and to convey a document, the present invention is not restricted by the type of the conveying apparatus of the embodiment.

While the present invention has been described with reference to the particular illustrative embodiments, it is not restricted by those embodiments but only by the appended claims. It is to be appreciated that those skilled in the art can change and modify the embodiments without departing from the scope and spirit of the invention.

What is claimed is:

1. A document conveying apparatus for conveying a document manually inserted from an inserting section to an ejecting section via an exposing section comprising:

a conveying path extending from said inserting section via said exposing section to said ejecting section, means for conveying the document along said conveying path, a plurality of document detecting means disposed along said conveying path for operating in a predetermined sequence when the document is normally conveyed, means for detecting an abnormality in document conveyance depending on a state of each said detecting means at a predetermined timing, and means for stopping an operation of said abnormality detecting means when said plurality of detecting means operate in a sequence other than said predetermined sequence.

2. A document conveying apparatus according to claim 1, wherein said stopping means stops the operation of said conveying apparatus.

3. A document conveying apparatus according to claim 1, wherein said document detecting means includes a plurality of document detecting elements and a plurality of timers.

4. A document conveying apparatus for conveying a document manually inserted from an inserting section to an ejecting section via an exposing section comprising:

a conveying path extending from said inserting section via said exposing section to said ejecting section, means disposed along said conveying path for conveying the document;

first and second document detecting means each disposed along said conveying path, said second document detecting means being disposed at a location downstream in a conveying diretion with respect to said first document detecting means, means for detecting an abnormality of document conveyance based on detected states respectively of said first and second document detecting means, means for initiating said conveying means and said abnormality detecting means in response to said first document detecting means, and means for stopping operations of said conveying means and said abnormality detecting means, while said first document detecting means is detecting the document, when said second document detecting means changes from a document detecting state to a state where the document is not detected.

5. A document conveying apparatus according to claim 4, wherein said abnormality detecting means includes a timer which starts in response to a first document detection.

6. A document conveying apparatus according to claim 4, wherein said stopping means stops the operation of the conveyance.

* * * * *